US005237810A

United States Patent [19]

Stalder et al.

[11] Patent Number: 5,237,810

[45] Date of Patent: Aug. 24, 1993

[54] METHOD AND APPARATUS FOR FALSE TWIST SPINNING

[75] Inventors: Herbert Stalder, Kollbrun; Rolf Binder, Raterschen, both of Fed. Rep. of Germany

[73] Assignee: Maschinenfabrik Rieter AG, Winterthur, Switzerland

[21] Appl. No.: 878,496

[22] Filed: May 5, 1992

Related U.S. Application Data

[63] Continuation-in-part of Ser. No. 576,074, Aug. 31, 1990, abandoned.

[30] Foreign Application Priority Data

Sep. 1, 1989 [CH] Switzerland ..... 03184/89-9

[51] Int. Cl.[5] ..... D01H 15/00; D01H 1/115

[52] U.S. Cl. ..... 57/328; 57/318; 57/331; 57/333; 57/334; 57/350

[58] Field of Search ..... 57/328, 331, 333, 334, 57/336, 340, 350, 318

[56] References Cited

U.S. PATENT DOCUMENTS

| | | | |
|---|---|---|---|
| Re. 31,705 | 10/1984 | Morinashi | 57/350 X |
| 3,488,941 | 1/1970 | Asaka | 57/340 X |
| 4,124,972 | 11/1978 | Arai et al. | 57/350 X |
| 4,406,116 | 9/1983 | Maier | 57/340 X |
| 4,509,322 | 4/1985 | Briner et al. | 57/328 X |
| 4,519,204 | 5/1985 | Dammann et al. | 57/340 |
| 4,674,274 | 6/1987 | Kato | 57/333 X |
| 4,852,341 | 8/1989 | Kato et al. | 57/331 X |
| 4,959,952 | 10/1990 | Kato et al. | 57/328 X |

FOREIGN PATENT DOCUMENTS

| | | | |
|---|---|---|---|
| 0131170 | 6/1984 | European Pat. Off. . | |
| 0222981 | 8/1986 | European Pat. Off. . | |
| 0305971 | 8/1988 | European Pat. Off. . | |
| 0321885 | 12/1988 | European Pat. Off. . | |
| 2722319 | 7/1978 | Fed. Rep. of Germany . | |
| 3639031 | 5/1987 | Fed. Rep. of Germany . | |
| 3818370 | 12/1988 | Fed. Rep. of Germany | 57/328 |

OTHER PUBLICATIONS

Krause, H. W. "Wirkungsweise Verschiedener Drallelemente Beim Falschdraht-Spinnen" Melliant Textilberichte, Jan. 1987, pp. 7–11 (no translation).

*Primary Examiner*—Daniel P. Stodola
*Assistant Examiner*—William Stryjewski
*Attorney, Agent, or Firm*—Wolf, Greenfield & Sacks

[57] ABSTRACT

A novel false twist spinning process in which a sliver (60) is twisted by a mechanical force-twisting device (58) between the front rollers (54) of the drafting unit (51) and the draw off rollers (59). The spinning tension is so adjusted that the false-twisted sliver (60) is prevented from assuming a helical shape and a balloon shape at least in the zone between the nip line (10) of the drafting unit (51) and a yarn guiding element (55) disposed before the false twisting device. In an apparatus for the practice of the process, the mechanical false twisting device (58) comprises discs (58A) or aprons (58B) and the yarn guiding element (55) comprises of a false twisting nozzle (55A, 55B).

6 Claims, 4 Drawing Sheets

METHOD AND APPARATUS FOR FALSE TWIST SPINNING

CROSS-REFERENCE TO RELATED APPLICATIONS

This is continuation in-part of now abandoned U.S. patent application Ser. No. 07/576,074 filed Aug. 31, 1990 for Method and Apparatus For False Twist Spinning, the disclosure of which is expressly incorporated herein by reference.

BACKGROUND OF THE INVENTION

The invention relates to a process for false twist spinning of a spinning feed supplied as a single sliver with the use of a drafting unit, at least one mechanical false twisting device and a draw off roller pair, and to an apparatus for the practice of the process.

In such a process there must be at least some separation between the external fibers and the core fibers so that the external fibers can be twisted around the twisted core at a pitch angle other than the pitch angle of the core. In conventional spinning processes of this kind described in a review by Prof. Hans W. Krause in *Melliand Textilberichte* January 1987, pages 7–11, the separation or sorting out of the external fibers from the core fibers always depends at least to some extent upon the conditions in the twist inserting zone, as more fully described hereinafter in the description of the drawings and in connection with various variants of the false twist spinning process.

SUMMARY OF THE INVENTION

It is an object of the invention to provide a method and apparatus for producing a yarn of more uniform quality as more fully described herein with discussion and in relation to the prior art.

In accordance with the invention a stable spinning triangle is produced—i.e. the spinning triangle moves hardly at all along the nip line of the front rollers—and thus the quantity of external fibers can be determined by feeding without appreciable reaction due to twist insertion.

An important consideration in such processes is that fibers external to the core be so wound around the false twisted core that in a subsequent removal of the false twist the external fibers wrapped around the core have at least to some extent a genuine twist. Prior methods for achieving this aim are based on a single principle:

An external fiber has one end connected to the rotating yarn and is braked at some other place so that the rotation of the yarn leads to the external fiber being wrapped around the false twisted core. All the variants of this basic method are suitable for use in the novel spinning process.

BRIEF DESCRIPTION OF THE DRAWINGS

A description will first be given in greater detail of known prior art spinning processes, reference being made to the following drawings wherein.

DETAILED DESCRIPTION OF PREFERRED EMBODIMENTS

Figure 1:
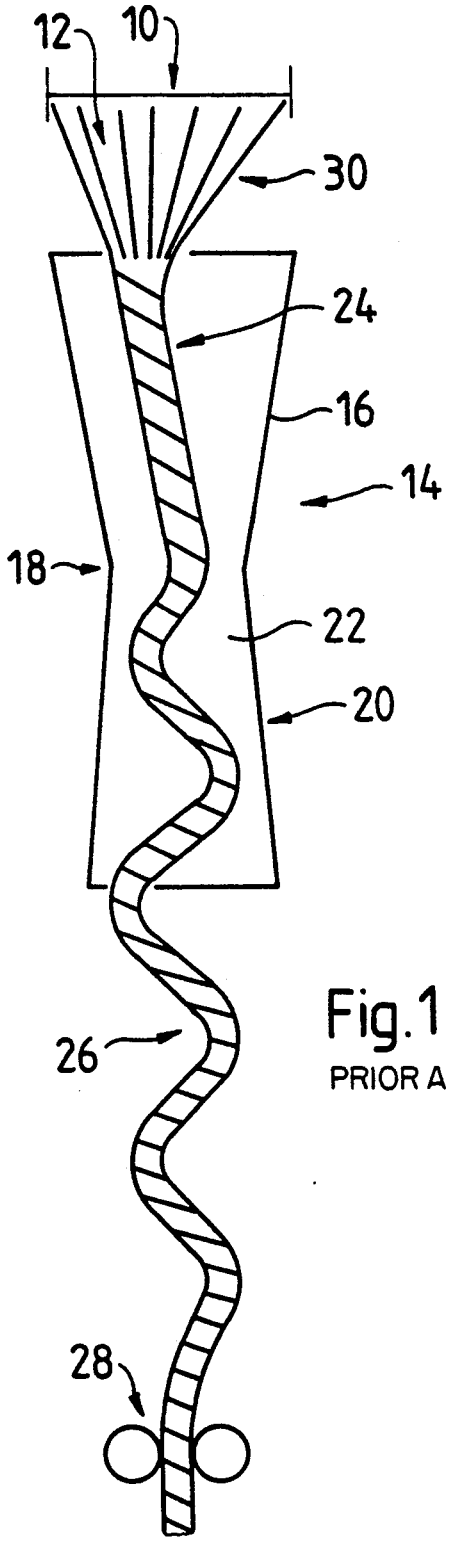
Fig. 1 PRIOR ART
FIG. 1 is a diagrammatic view helping to explain the conditions in a first false twist spinning process and showing an air jet spinning process in accordance with the process described in U.S. Pat. No. 4,124,972, the disclosure of which is incorporated herein by reference.

Referring to FIG. 1, the reference 10 denotes the nip line of front rollers of a drafting unit (not shown) for delivering fiber material 12 to a spinning device 14 comprising a guide portion 16, a restrictor portion 18 and a twist inserting portion 20. The portion 20 includes air nozzles (not shown) for producing a rotating or helical air flow in a twist chamber 22 so that fiber structure 24 is rotated around its own longitudinal axis in guide portion 16. After the chamber 22 the rotation of the fibers works in accordance with the principle of false twisting whereby the twist prior to chamber 22 is largely cancelled thus forming a substantially untwisted yarn core. Some of the core twist is transferred to the outer or edge fibers which wrap around the false-twisted fiber structure 24 in the parts 16, 20 with a pitch angle different from the pitch angle of the core fibers. After the draw off rollers 28, these external or edge fibers continue to be wrapped around the core fibers and determine the strength of the finished spun yarn 26 drawn off by draw off rollers 28.

The fiber material 12 delivered by the drafting unit (not shown) comprises at the nip line 10 a substantially parallelized and weakly cohering sliver. The fibers are combined to form a consolidated fiber structure 24 in the spinning triangle 30 by propagation of the twist of the false twisted core. Such fiber structure must be strong enough to withstand the spinning tension. Conditions in spinning triangle 30 will be described in greater detail hereinafter with reference to FIGS. 3A–E. A description is first given of the spinning conditions in another variant of an air jet spinning process occurring with reference to FIG. 2, elements which have substantially the same effect having the same references as in FIG. 1.

Figure 2:
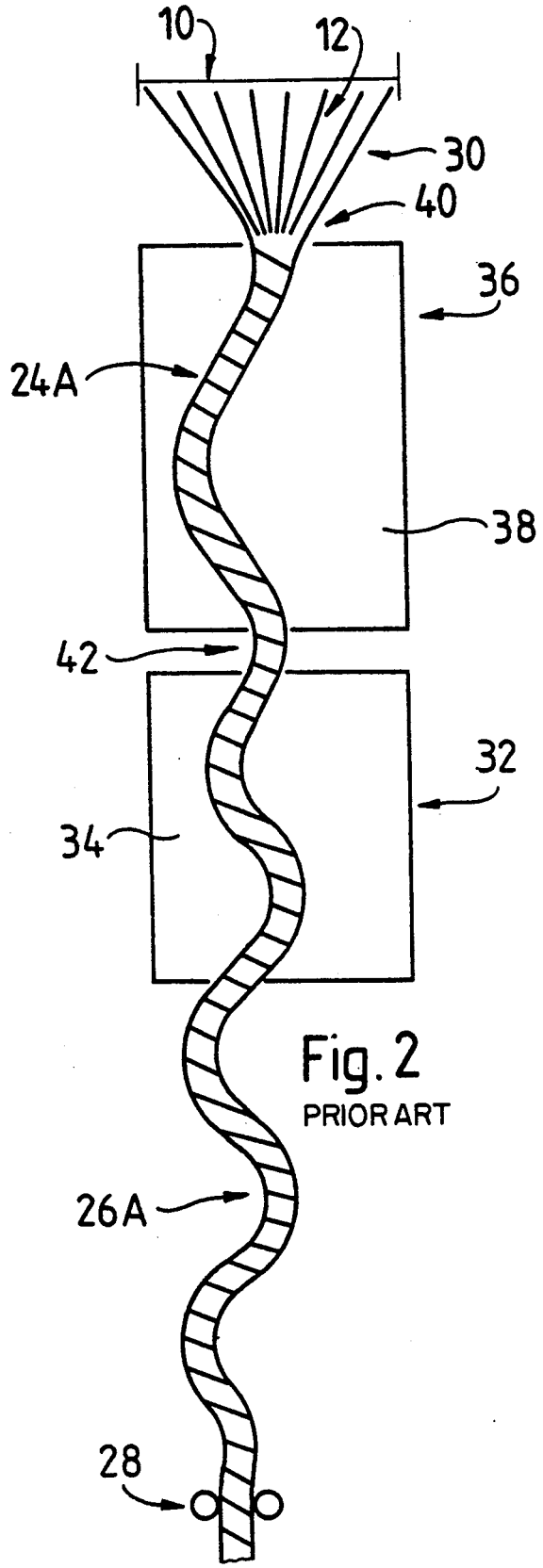
Fig. 2 PRIOR ART
FIG. 2 is a corresponding diagrammatic illustration of the conditions in another known false twist spinning process.

The process illustrated in FIG. 2 corresponds to a description set forth in U.S. Pat. No. Re. 31,705, particularly with respect to FIG. 5 therein. The fiber material 12 on the nip line 10 of a drafting unit (not shown) is combined to form a fiber structure 24A by propagation of a twist. The false twisting of the core is produced in a false twisting device 32 comprising air nozzles which create a helical air flow (not shown) and a twist chamber 34. The system differs considerably from the system shown in FIG. 1 in that a second false twisting device 36 having air nozzles also creating a helical air flow (not shown) and a twist chamber 38 is present between the first false twisting device 32 and the drafting unit. The second twisting device 36 produces a twist opposite to the effect produced by the device 32, a step which according to U.S. Pat. No. Re. 31,705 serves to inhibit propagation of the full twist of the core into the spinning triangle and to loosen the fiber structure with a corresponding production of external (or edge) fibers. This effect of the device 36 is said to produce ballooning in the chamber 38, to which end the entry 40 and exit 42 of the chamber 38 must be narrow to produce nodes of the balloon. Whether this explanation of the effect of the device 36 is completely accurate need not be discussed here. The conditions in the chambers 22, 32 will first be described in greater detail.

The twist-producing chambers of U.S. Pat. No. 4,124,972 and U.S. Pat. No. Re. 31,705 are not identical to one another and so are not given the same references herein. However, they are said to operate identically in at least one respect, i.e. in forming a spiral in the yarn 26 and 26A between the twisting chamber and the draw-off rollers 28 as a result of the helical air flow action on the yarn. Without this spiralling no rotation of the yarn core and therefore no propagation of the core twist as far back as the spinning triangle 30 occurs.

To facilitate the spiralling, it is vital to properly limit the tension in the fiber structure between the nip line 10 and the draw off rollers 28, as was recognized relatively early in, for example, DE-A-2,042,387. In more recent false twist spinning processes, air jet twist inserting devices have been replaced by mechanical devices, as described, for example, in DE-A-3,437,343 and DE-3,639,031.

In such processes it is unnecessary to limit the tension in the fiber structure—i.e. the total draft—in order to produce core twist. However, both processes still require ballooning or helix formation in the yarn structure produced by the main twist producing device in the spinning direction. This is possible only with reduced tension in the fiber structure and calls for the feature hereinbefore mentioned of narrowing the entry of the false twisting device disposed after the drafting unit, to ensure that the balloon forms a node there.

Figure 3A:
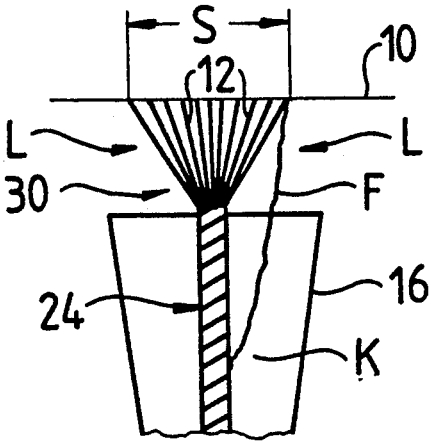
FIGS. 3A–E are a series of sketches explaining the accumulation of fibers in a spinning process in accordance with the diagram of FIG. 1.
Figure 3B:
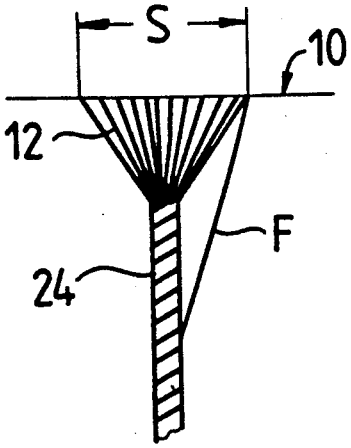
Figure 3C:
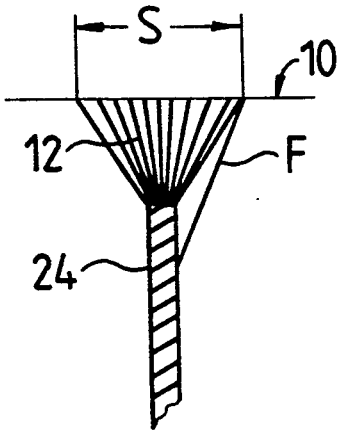

The effects of these circumstances are described with reference to FIGS. 3A–E of the accumulation of external (or edge) fibers on the core in a system according to FIG. 1 and with reference to FIGS. 4A–B of accumulation of fibers in a system according to FIG. 2. The sketch of FIG. 3A shows the guide member 16 of the spinning device, the nip line 10, the fiber material 12 and the spinning triangle 30. The member 16 has been omitted from FIGS. 3B to 3E but they show the same spinning system at various times. It can be assumed that the drafting unit delivers fibers over a predetermined width S of the nip line 10. Most of the fibers 12 are taken up into the false twisted core in the spinning triangle 30. Other fibers, edge or external fibers, are formed which eventually are wrapped around the false twisting core. For purposes of explanation, an edge fiber F is shown as leaving the spinning triangle at the right hand end of the delivery width S. The fiber F is aspirated into the entry of the guide member 16 by the suction of air flows L. The member 16 is so devised that the front or head K of the fiber F is guided past the false-twisted core in the spinning direction of the spinning triangle. The head K is then engaged by the rotating fiber structure (FIG. 3B) and starts to wrap therearound. As described more fully in U.S. Pat. No. 4,124,972, the other end of this edge fiber is provisionally clamped in the nip line 10. Consequently, the still unengaged part of the edge fiber F moves against the spinning direction to the spinning triangle 30 (FIG. 3C). This action ultimately results in the difference between core fiber pitch angle and wrapped edge fiber pitch angle. For purposes of better representation of the wrapping procedure the rotation (spiralling or helix) action of the core has deliberately been omitted from FIGS. 3A–E.

The tail of the fiber F is ultimately either forced into the spinning triangle 30 and taken up into the core (FIG. 3D) or simply released from the nip line 10.

Figure 3D:
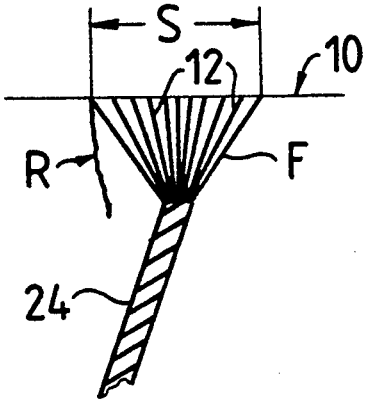
Figure 3E:
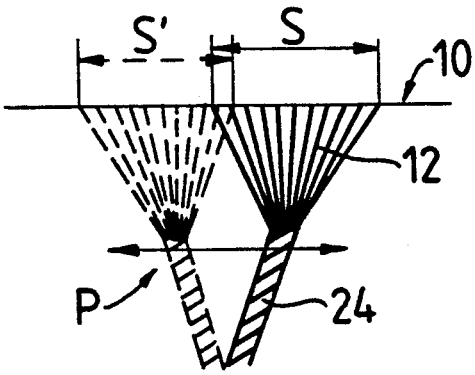
Figure 4A:
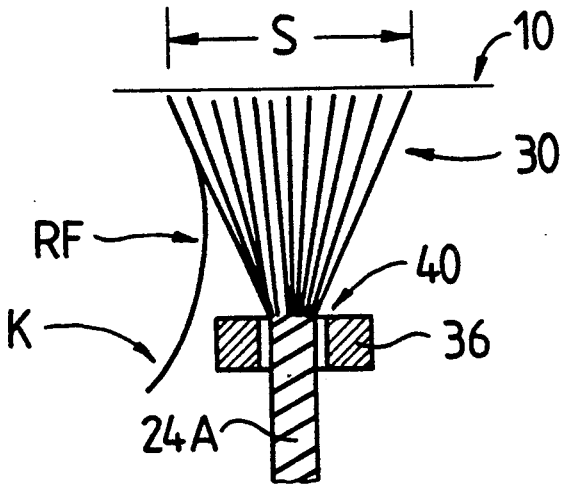
FIGS. 4A–B are a series of sketches explaining fiber accumulation in a process in accordance with the diagram of FIG. 2.
Figure 4B:
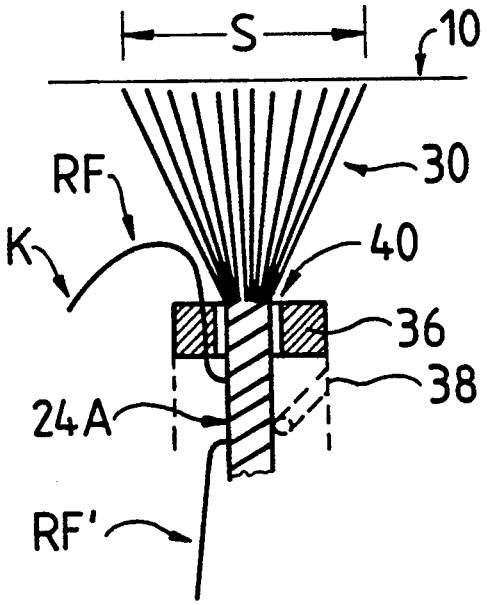

If the edge fiber F is not too short so as not to be released too quickly from the nip line 10, the tension applied to the fiber F shifts the structure 24 from its original central position relative to the delivery width S (FIG. 3A) in a direction towards the still tucked-in end of the edge fiber F (FIGS. 3C and 3D). This results in the spinning triangle 30 becoming asymmetrical, as can be seen clearly in FIG. 3D. The asymmetry leads to spinning triangle conditions suitable for producing an edge fiber R at the left hand end of the width S (FIG. 3D). In a process according to U.S. Pat. No. 4,124,972 the structure 24 therefore oscillates from side to side of the width S (FIG. 3E) forming a helix or balloon. This oscillation or to-and fro motion plays an important part in the production of edge wrapping) fibers in such a process. Such operation and formation of a helix or balloon in structure 24 depends upon a reduced tension in the structure 24. The tension exerted by the draw off rollers 28 on the yarn 26 must not exceed a predetermined value if the edge fiber generation conditions in or around the spinning triangle are not to be impaired.

The conditions in a system according to FIG. 2 are clearly different since in this case the restriction 40 at the entry into the twisting device 36 inhibits oscillation of the apex of the spinning triangle 30. Also, in a system of the kind shown in FIG. 2 no free leading or head ends of the edge fibers can be routed forwardly to the rotating core. In a system according to FIG. 2 the tail of an edge fiber RF (FIG. 4A) must previously be engaged in the spinning triangle 30 and incorporated in the core, for otherwise this fiber will be lost as fly upon release from the nip line 10. Head end K of the edge fiber RF must be dragged downwardly towards the draw off into the twisting device 36 by the downward translational motion of the structure 24A (FIG. 4B). In the device 36 the free fiber length is drafted by friction on the passage walls. By means of compressed air, an air eddy is produced through the bores 38 in the device 36 and deflects the free end of the edge fibers RF′ into the direction of yarn movement, then wraps them around the rotating core in the opposite direction of rotation. In this event the conditions in the spinning triangle 30 are stable (not oscillating) and so the same can stay symmetrical. These conditions are produced by the narrow entry 40 and the proximity thereof to the apex of the spinning triangle 30 and not by control of tension in the yarn structure 4A.

Figure 5:
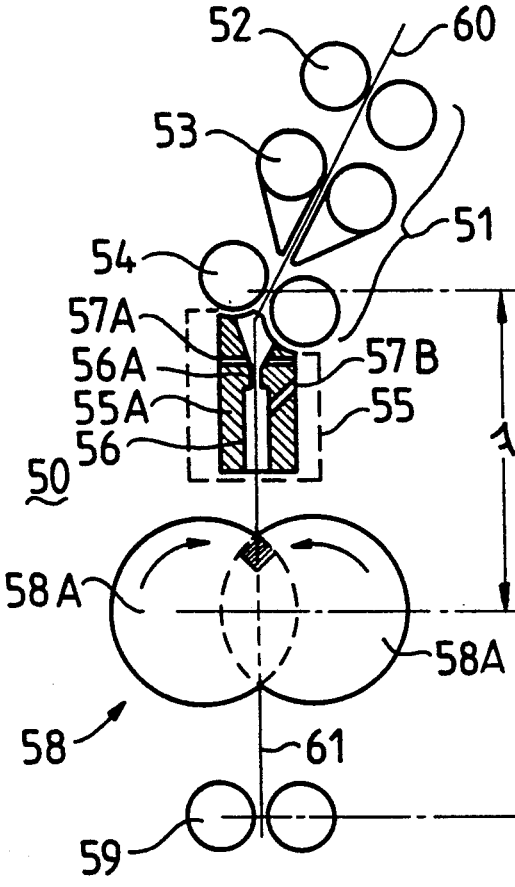
FIG. 5 shows a first exemplary novel apparatus according to the invention for the practice of a novel spinning process according to the invention.
Figure 6:
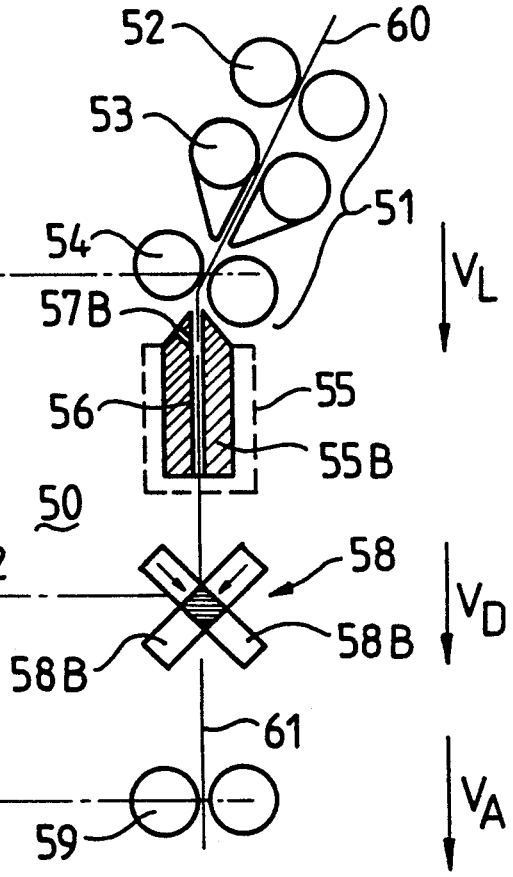
FIG. 6 shows a second exemplary novel apparatus according to the invention for the performance of a novel spinning process according to the invention.

Substantially the same references are used for like elements in FIGS. 5 and 6. A spinning device 50 comprises a drafting unit 51, a guide element 55, a mechanical twisting element 58 and draw off rollers 59. The drafting unit 51 comprises back rollers 52, an apron type drafting unit 53 and front rollers 54. Referring to FIG. 5, the guide element 55 has a nozzle funnel-shaped inlet and a nozzle passage 56. Transverse bores 57A are disposed immediately before the termination of the funnel shaped inlet and are connected to a negative pressure source (not shown) for aspiration. Tangential bores 57B are disposed after the exit or restriction 56A of the passage 56 creating a downstream helical air flow. The mechanical twisting element 58 comprises two discs 58A preferably comprising an elastomeric material such as polyurethane and are disposed in parallel planes with an overlapping zone and driven in opposite rotational directions so that the sliver 60 passing through is rotated by friction in the hatched zone and spun into a yarn 61. In FIG. 6 the guide element 55 of the device 50 has a nozzle 55B with a continuous unidimensional nozzle passage 56 into which bores 57B enter tangentially, the bores 57B forming an obtuse angle with the direction of yarn movement which produce a downward helical air flow therein.

Figure 7:
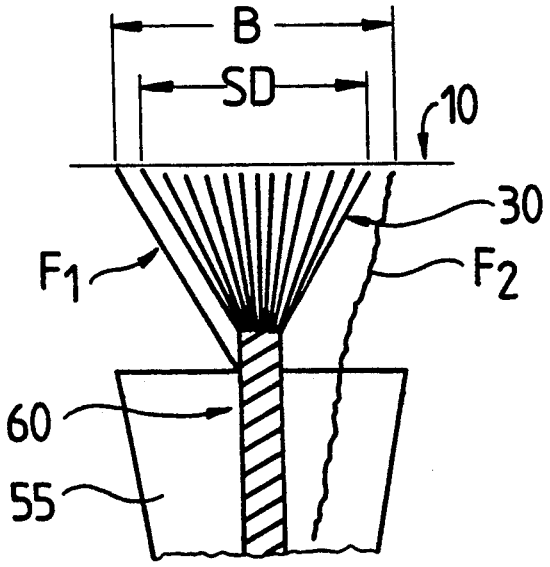
FIG. 7 is a sketch serving to illustrate the conditions in a spinning triangle in a novel spinning process according to the invention.

The mechanical twisting element 58 of FIG. 6 comprises two aprons 58B moving in opposite directions to one another. The aprons 58B are endless and driven on two rollers (not shown). The sliver 60 passing through experiences rotation and tension in the friction zone (shown hatched). The main drafts in the actual spinning zone are the draft $\lambda_1$—i.e. the ratio of the speed $V_L$ at which the sliver 60 passes the front roller 54 of the drafting unit 51 and the speed $V_D$ at the mechanical twisting element 58—and the draft $\lambda_2$—i.e. the ratio of the speed $V_L$ and the speed $V_A$ of the yarn at the draw off rollers 59. Each draft thus has a magnitude. The ratio $\lambda_1$:$\lambda_2$ of the two drafts (or of the magnitude of the drafts) is such that a high spinning tension is produced between the nip line of the front rollers 54 and the mechanical twisting element 58. The high spinning tension ensures that the spinning triangle 30 of the sliver 60 can oscillate only to a minor extent, if at all, along the nip line of the front rollers 54 (FIG. 7), a helical shape and a balloon shape in the false twisted sliver being prevented by such tension at least in the zone between the nip line of the last set of rollers of the drafting mechanism and the helical air circulating mechanism. The advantage of forming a locally stable spinning triangle is that effects on the stability of spinning conditions are clearly predictable and the formation of helical and balloon shapes is prevented in the yarn at least between the nip line of the delivery rollers and the helical air circulating mechanism. Substantially all of the sliver fibers delivered over a length SD, FIG. 7, of the nip line 10 reach the twisted core. Fibers F1, F2 delivered outside the length SD are effective as edge fibers—i.e. as external or wrap fibers. Optimal conditions for the wrap fibers to accumulate near the spinning triangle 30 are provided. These optimal conditions depend upon the staple length of the particular fiber material used and upon the ratio between the drafts $\lambda_1$ and $\lambda_2$ in the spinning system, for it has proved satisfactory if the distance between the entry of passage 56 of guide element 55 and the nip line 10 is from 60 to 75%, preferably from 68 to 72%, of the average fiber length of the sliver to be spun. Advantageously, the draft $\lambda_1$ is greater than unity and the draft $\lambda_2$ is approximately unity so that a spinning tension of at least 1.5 cN/tex arises. The term "unity" is used inits conventional sense meansing 1:1 or 1/1 or one. The size and shape of the spinning triangle (FIG. 7) is determined by the spinning tension (yarn tension) but the number of edge fibers can be determined independently over the total delivery width B associated with the drafting unit.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. Process for false twist spinning a sliver of fibers into a spun yarn in a spinning apparatus comprising a drafting mechanism, a helical air circulating mechanism, a mechanical false twisting mechanism and a draw-off mechanism, the sliver being spun into a yarn and delivered successively to the helical air circulating mechanism and to the mechanical false twisting mechanism and drawn off from the mechanical false twisting mechanism by the draw-off mechanism, a tension being created in the yarn during its processing, the process comprising creating a first draft having a first selected magnitude between the mechanical twisting mechanism and the drafting mechanism and a second draft having a second selected magnitude between the draw-off mechanism and the drafting mechanism, the magnitude of the first draft being selected to be greater than the magnitude of the second draft such that a tension is created in the spun yarn between the drafting mechanism and the mechanical false twisting mechanism which prevents the false twisted yarn from assuming a helical and a balloon shape at least between the helical air circulating mechanism and the drafting mechanism.

2. A process according to claim 1 wherein the magnitude of the first draft is selected to be greater than one and the magnitude of the second draft is selected to be approximately one, the spinning tension in the sliver being spun into a yarn between the drafting mechanism and the mechanical false twisting mechanism being at least about 1.5 cN/tex.

3. Method for stabilizing the uniformity of yarn formed by false twisting, comprising:

drafting a sliver of fibers and routing the drafted sliver through the nip of a pair of feed rollers;

routing the sliver emerging from the rollers into a first treatment zone of helically circulating air having an entry, the helically circulating air routing the sliver into a second treatment zone;

mechanically false twisting the sliver in the second treatment zone to form a core of false twisted yarn from the sliver;

the mechanical twisting forming a tension of at least 1.5 cN/tex in the yarn being spun between the second zone and the feed rollers such that the sliver emerging from the rollers forms a sliver triangle of fibers between the nip of the rollers and the entry into the first zone, the triangle of fibers being twisted into the core of false twisted yarn by the mechanical false twisting in the second zone and edge fibers being formed in the triangle of fibers emerging from the rollers, the edge fibers having a free end not caught in the core;

the helically circulating air in the first zone wrapping the free ends of the edge fibers around the false twisted core of the yarn and exerting an oscillating force on the yarn;

the tension formed in the yarn by the mechanical twisting stabilizing the triangle of fibers against the oscillating force.

4. The method of claim 3 further comprising drawing the mechanically twisted yarn off at a position subsequent to the mechanical twisting and creating one draft of a first selected magnitude between the drawing off position and the free rollers and creating another draft of a second selected magnitude between the mechanical twisting zone and the feed rollers, the magnitude of the first draft being selected to be greater than the magnitude of the second draft such that the yarn is prevented from assuming a helical or balloon shape at least between the rollers and the first zone.

5. Process for false twist spinning a sliver of fibers into a spun yarn in a spinning apparatus comprising a drafting mechanism, a helical air circulating mechanism, a mechanical false twisting mechanism and a draw-off mechanism, wherein the sliver is delivered from the drafting mechanism successively to the air-circulating mechanism, the mechanical false twisting mechanism and the draw-off mechanism, the method comprising:

spinning the sliver into a yarn in the air-circulating mechanism;

creating a first draft between the mechanical false twisting mechanism and the drafting mechanism having a first selected magnitude;

creating a second draft between the draw-off mechanism and the drafting mechanism having a second selected magnitude which is less than the magnitude of the first draft; and selecting the magnitude of the first draft such that a tension is created in the yarn between the drafting mechanism and the mechanical false twisting mechanism which prevents the yarn from assuming a helical and a balloon shape at least between the helical air circulating mechanism and the drafting mechanism.

6. A process according to claim 5 wherein the magnitude of the first draft is selected to be greater than one and the magnitude of the second draft is selected to be approximately one such that the spinning tension in the yarn being spun between the drafting mechanism and the mechanical false twisting mechanism is at least 1.5 cN/tex.

* * * * *